US009777356B2

(12) United States Patent
Yamakawa et al.

(10) Patent No.: US 9,777,356 B2
(45) Date of Patent: Oct. 3, 2017

(54) AUSTENITIC FE—NI—CR ALLOY

(71) Applicant: NIPPON YAKIN KOGYO CO., LTD., Tokyo (JP)

(72) Inventors: Kazuhiro Yamakawa, Kanagawa (JP); Shigeru Hirata, Kanagawa (JP); Kun Wang, Kanagawa (JP)

(73) Assignee: NIPPON YAKIN KOGYO CO., LTD., Tokyo (JP)

( * ) Notice: Subject to any disclaimer, the term of this patent is extended or adjusted under 35 U.S.C. 154(b) by 0 days.

(21) Appl. No.: 14/850,115

(22) Filed: Sep. 10, 2015

(65) Prior Publication Data

US 2015/0376752 A1 Dec. 31, 2015

Related U.S. Application Data

(63) Continuation of application No. 13/867,255, filed on Apr. 22, 2013, now abandoned.

(30) Foreign Application Priority Data

May 21, 2012 (JP) ..... 2012-115787

(51) Int. Cl.
*C22C 38/52* (2006.01)
*C22C 38/44* (2006.01)
(Continued)

(52) U.S. Cl.
CPC ..... *C22C 38/52* (2013.01); *C22C 1/02* (2013.01); *C22C 30/02* (2013.01); *C22C 38/001* (2013.01);
(Continued)

(58) Field of Classification Search
CPC ..... C22C 38/44; C22C 38/52
(Continued)

(56) References Cited

U.S. PATENT DOCUMENTS 4,421,571 A 12/1983 Kudo et al.
5,098,652 A * 3/1992 Yasui ..... C22C 38/40 420/45
(Continued)

FOREIGN PATENT DOCUMENTS

JP 60-230966 11/1985
JP 61-060868 3/1986
(Continued)

OTHER PUBLICATIONS

Peckner D et al "Handbook of stainless steels, Passage", Handbook of stainless steels, XP002053955, Jan. 1, 1977, pp. 14.02.
(Continued)

*Primary Examiner* — Brian Walck
(74) *Attorney, Agent, or Firm* — Greenblum & Bernstein, P.L.C.

(57) ABSTRACT

An austenitic Fe—Ni—Cr alloy comprises C: 0.005~0.03 mass %, Si: 0.17~1.0 mass %, Mn: not more than 2.0 mass %, P: not more than 0.030 mass %, S: not more than 0.0015 mass %, Cr: 18~28 mass %, Ni: 21.5~32 mass %, Mo: 0.10~2.8 mass %, Co: 0.05~2.0 mass %, Cu: less than 0.25 mass %, N: not more than 0.018 mass %, Al: 0.10~1.0 mass %, Ti: 0.10~1.0 mass %, Zr: 0.01~0.5 mass %, and the balance being Fe and inevitable impurities; wherein Cr, Mo, N and Cu satisfy $PRE=Cr+3.3\times Mo+16\times N\geq 20.0$ and $PREH=411-13.2\times Cr-5.8\times Mo+0.1\times Mo^2+1.2\times Cu\leq 145.0$ and wherein Al, Ti, and Zr satisfy $0.5\leq Al+Ti+1.5\times Zr\leq 1.5$, and has an excellent corrosion resistance in air or under a wet environment even at a surface state having an oxide film formed by an intermediate heat treatment.

2 Claims, 2 Drawing Sheets

(51) Int. Cl.

| | |
|---|---|
| ***C22C 38/58*** | (2006.01) |
| ***C22C 38/42*** | (2006.01) |
| ***C22C 38/04*** | (2006.01) |
| ***C22C 38/02*** | (2006.01) |
| ***C22C 38/00*** | (2006.01) |
| ***C22C 30/02*** | (2006.01) |
| ***C22C 1/02*** | (2006.01) |
| ***C22C 38/06*** | (2006.01) |
| ***C22C 38/50*** | (2006.01) |

(52) U.S. Cl.
CPC ..... *C22C 38/002* (2013.01); *C22C 38/004* (2013.01); *C22C 38/02* (2013.01); *C22C 38/04* (2013.01); *C22C 38/06* (2013.01); *C22C 38/42* (2013.01); *C22C 38/44* (2013.01); *C22C 38/50* (2013.01); *C22C 38/58* (2013.01)

(58) Field of Classification Search
USPC ..... 148/327; 420/38, 582–586
See application file for complete search history.

(56) References Cited

U.S. PATENT DOCUMENTS

| | | | | |
|---|---|---|---|---|
| 2005/0016636 | A1 | 1/2005 | Kobayashi et al. | |
| 2006/0191600 | A1 * | 8/2006 | Omura ..... | C21D 6/002 148/287 |

FOREIGN PATENT DOCUMENTS

| | | | | |
|---|---|---|---|---|
| JP | 63-121641 | | 5/1988 | |
| JP | EP 1645649 | A1 * | 4/2006 | ..... C22C 38/001 |
| JP | 2006-315079 | | 11/2006 | |

OTHER PUBLICATIONS

Search report from E.P.O. for EP Application No. 13 16 6927, mailed Aug. 30, 2013.

* cited by examiner

【Fig.1】
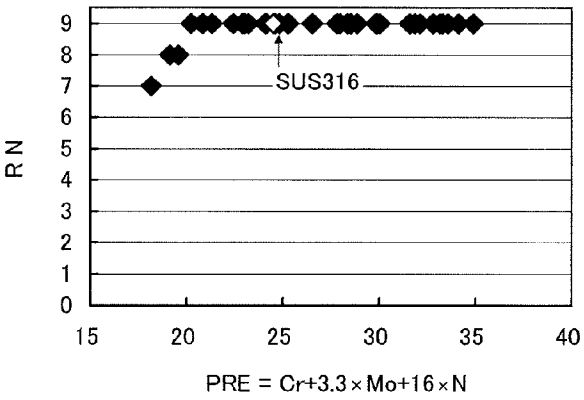
【Fig.2】
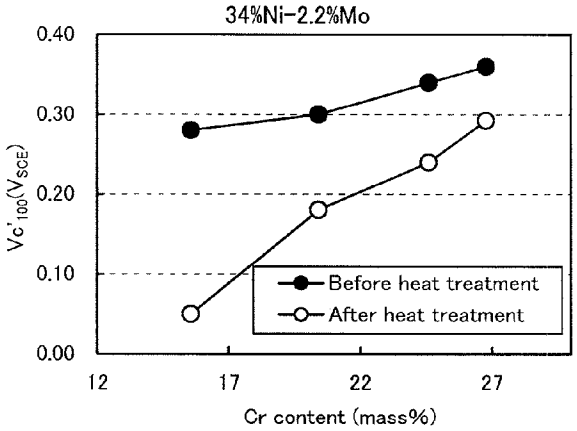
【Fig.3】
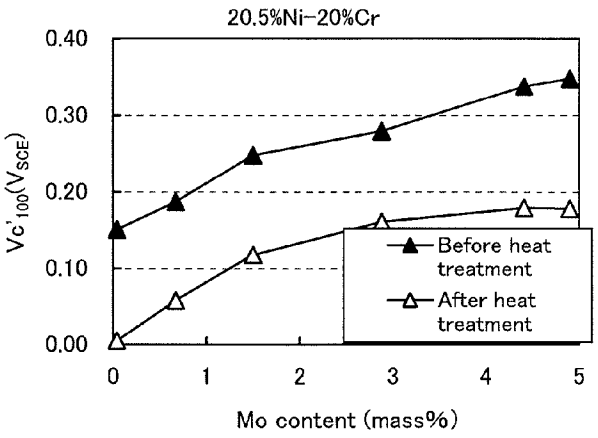
【Fig.4】
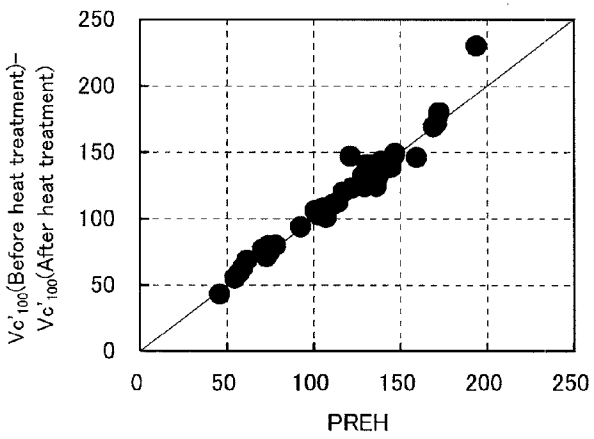

【Fig.5】
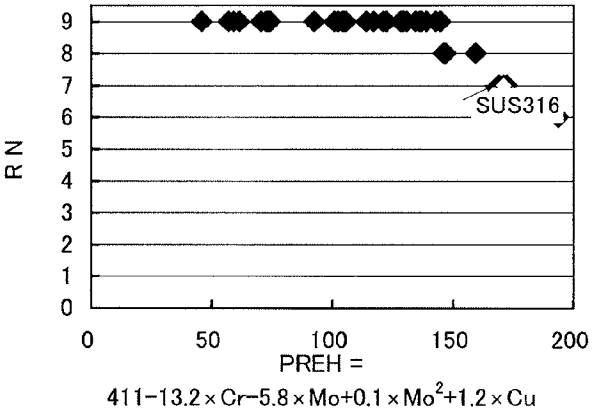
【Fig.6】
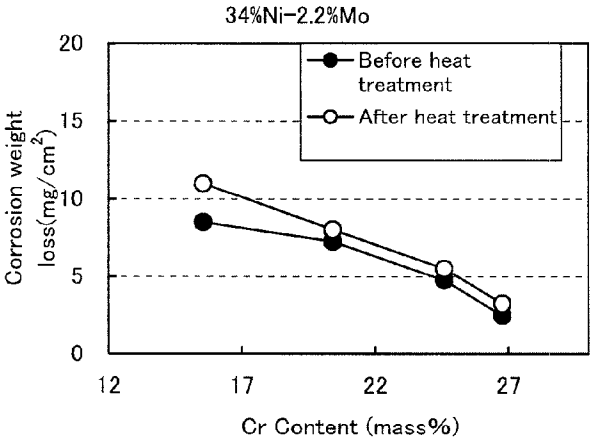
【Fig.7】
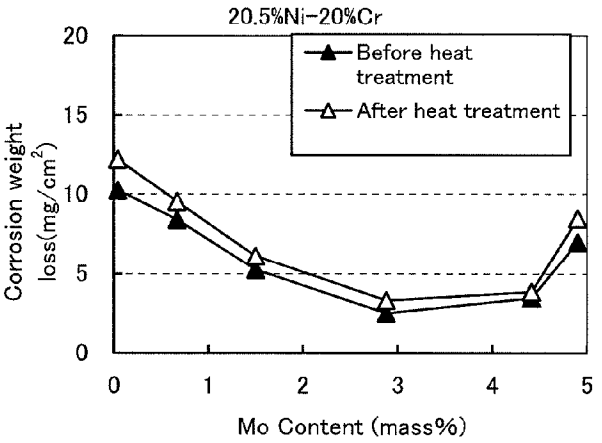
【Fig.8】
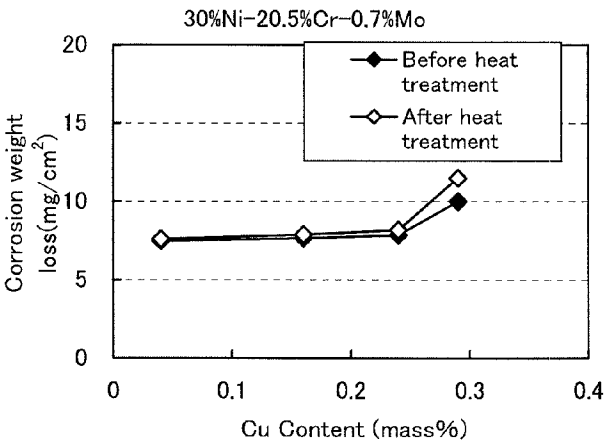

AUSTENITIC FE—NI—CR ALLOY

The present application is a continuation of U.S. application Ser. No. 13/867,255 filed Apr. 22, 2013, which claims priority to Japanese Application No. 2012-115787 filed May 21, 2012, the disclosures of each application being incorporated by reference herein in their entirety.

TECHNICAL FIELD

This invention relates to an austenitic Fe—Ni—Cr alloy, and more particularly to an austenitic Fe—Ni—Cr alloy suitable for use in a sheathing tube of a so-called sheath heater or the like and being excellent in not only the high-temperature corrosion resistance in air and the corrosion resistance under a wet condition in water or the like but also the blackening treatability.

RELATED ART

A sheath heater using a nichrome wire is frequently used in a heat source for electric cooking devices, an electric water heater and the like. In the sheath heater, heating is carried out by inserting the nichrome wire into a sheathing tube made of a metal, filling a space portion thereof with magnesia powder or the like to completely seal the tube, and then applying an electric current to the nichrome wire to generate heat. This heating system is high in safety because of no use of fire and is widely used in an electric cooking device such as fish firing grill or the like, an electric water heater and so on as an essential item for so-called all-electric home, so that its demand is drastically enlarging in late years.

However, if holes or cracks are caused in the sheathing tube of the sheath heater, short circuit or disconnection of the nichrome wire is caused and hence function as a heat source is not developed. For example, the sheath heater used in the fish firing grill is generally arranged just beneath and/or just above a target to be cooked and used at a state of being heated to a high temperature of 700~900° C. in air. However, if foreign matter including fat, salt or the like of the target to be cooked is adhered to the surface of the sheathing tube, or if adjacent sheathing tubes are contacted with each other in use depending on the arrangement of the sheath heaters, abnormal oxidation or abnormal corrosion is locally caused. Therefore, the sheathing tube of the sheath heater is required to be excellent in the oxidation resistance and corrosion resistance even at a high-temperature heated state.

Also, the sheathing tube of the sheath heater is repeatedly subjected to heating and cooling in use, so that it is required to be excellent in high-temperature strength, resistance to heat shock, resistance to repetitive oxidation and the like and also a black oxide film having high density and emissivity can be formed on the surface of the tube for efficiently realizing rapid heating.

On the other hand, it is known in the sheath heater used in the electric water heater or the like that water stain is adhered to the surface of the sheathing tube or pitting corrosion or crevice corrosion is caused in a packing seal portion by chlorine content included in tap water and that stress corrosion cracking is easily caused when the sheathing tube is used at a state of causing internal stress. Therefore, the sheathing tube of the sheath heater is desired to be excellent in the corrosion resistance and the resistance to stress corrosion cracking under wet environment.

Recently, the sheath heater is frequently arranged in a complicated shape by making a radius of curvature in U-shaped bent portion or a spiral portion small for attaining miniaturization or high efficiency, and cracking is frequently caused in the sheathing tube associated therewith. In order to cope with the above problem, the sheathing tube is softened by subjecting to heat treatment at a middle step (intermediate heat treatment) to remove working strain and thereafter working is again conducted to frequently finish into a given shape.

In general, this heat treatment is conducted at a lowest temperature required for softening in air or in a simple inert atmosphere, but an oxide film is formed on the surface of the sheathing tube associated therewith. The oxide film differs from the aforementioned black oxide film and deteriorates the corrosion resistance of the sheathing tube, so that it is desirable to remove the oxide film by polishing or pickling in use. As previously mentioned, however, it is difficult to completely remove the oxide film by polishing or pickling due to the complex formation of the shape of the sheath heater. Also, the removal of the oxide film is a cause bringing about the decrease of the production efficiency or the increase of the cost. As a result, the sheath heater becomes frequently used without removing the oxide film formed on the surface of the sheathing tube.

As a material used in the sheathing tube of the sheath heater, SUS 304, SUS 316 and so on are not sufficient in use under the aforementioned severer corrosion environment, so that SUS 310S having an enhanced Ni or Cr content, NH840, NCF 800 and so on are typically used. However, SUS 310S, NH840 and NCF 800 may become problematic in the corrosion resistance or the like depending on the use environment.

As a technique for further improving the corrosion resistance, Patent Document 1 proposes, for example, steels having an increased Ni content and added with Mo, W and V for high-temperature dry corrosion environment containing a chloride. Also, Patent Document 2 proposes a material improving resistance to repetitive oxidation by increasing an addition amount of Mo in consideration that heat cycles of room temperature and higher temperature are frequently applied to the electric cooking device. Furthermore, Patent Document 3 proposes an austenite stainless steel for a sheathing tube of a sheath heater having an oxidation resistance improved by increasing Cr content and adding Al and REM and a resistance to stress corrosion cracking improved by adding Co.

PRIOR ART DOCUMENTS

Patent Documents

Patent Document 1: JP-B-S64-008695
Patent Document 2: JP-B-S64-011106
Patent Document 3: JP-B-S63-121641

SUMMARY OF THE INVENTION

Task to be Solved by the Invention

However, all of the techniques disclosed in Patent Documents 1-3 do not consider corrosion resistance and the like under high-temperature air or under wet environment at a clear state existing no oxide film on the surface or at a state having an oxide film formed by the intermediate heat treatment, so that they have not necessarily sufficient characteristics in light of recent production steps of the sheathing tube.

As a result of the inventors' inspections, it is clear that when the defects relating to the sheathing tube of the sheath heater are classified according to the cause, in addition to poor welding and cracking resulted from simple plastic work, there are frequently caused two types of defects not too recognized up to the present, i.e. corrosion generated in a gap between a heater support portion and a sheathing tube with an oxide film formed at the production step of the sheathing tube, and abnormal oxidation associated with adhesion in a gap of a bending portion of the sheathing tube.

The invention is made in view of the above problems confronting in the conventional techniques, and is to provide an austenitic Fe—Ni—Cr alloy suitable for use in a sheathing tube of a sheath heater or the like and exhibiting an excellent corrosion resistance under a high-temperature in air or under a wetting environment even at a surface state having an oxide film formed by an intermediate heat treatment in the production process.

The inventors have made various studies for solving the above task. As a result, it has been found that in order to prevent the defects on the corrosion resistance and the like in the sheathing tube of the sheath heater, a parameter PREH indicating a difference of a pitting potential measurement before and after heat treatment is introduced in addition to a parameter PRE usually used for evaluation of the corrosion resistance and the PREH is necessary to be controlled to a proper range, and the invention has been accomplished.

That is, the invention proposes an austenitic Fe—Ni—Cr alloy having a chemical composition comprising C: 0.005~0.03 mass %, Si: 0.15~1.0 mass %, Mn: not more than 2.0 mass %, P: not more than 0.030 mass %, S: not more than 0.002 mass %, Cr: 18~28 mass %, Ni: 20~38 mass %, Mo: 0.10~3 mass %, Co: 0.05~2.0 mass %, Cu: less than 0.25 mass %, N: not more than 0.02 mass %, provided that Cr, Mo, N and Cu satisfy the following equations (1) and (2):

$$PRE=Cr+3.3\times Mo+16\times N\geq 20.0 \quad (1)$$

$$PREH=411-13.2\times Cr-5.8\times Mo+0.1\times Mo^2+1.2\times Cu\leq 145.0 \quad (2)$$

(wherein each element symbol in the above equations represents a content (mass %) of each element), and the balance being Fe and inevitable impurities.

In addition to the above chemical composition, the austenitic Fe—Ni—Cr alloy of the invention contains one or more selected from Al: 0.10~1.0 mass %, Ti: 0.10~1.0 mass % and Zr: 0.01~0.5 mass % and satisfying the following equation (3):

$$Al+Ti+1.5\times Zr:\ 0.5\sim 1.5 \quad (3)$$

(wherein each element symbol in the above equation represents a content (mass %) of each element).

Effect of the Invention

According to the invention, there can be manufactured a sheathing tube for sheath heater having an excellent corrosion resistance even at a state of retaining an oxide film formed in the production process and being excellent in the blackening treatability, so that the invention largely contributes to not only the reduction of the production cost but also the lifetime extension of a product using the sheath heater.

BRIEF DESCRIPTION OF THE DRAWINGS

FIG. 1 is a graph showing a relation between PRE and ratio of rust development RN after salt spray test.

FIG. 2 is a graph showing an influence of Cr content upon pitting potential before and after intermediate heat treatment.

FIG. 3 is a graph showing an influence of Mo content upon pitting potential before and after intermediate heat treatment.

FIG. 4 is a graph showing a relation between found value and predicted value PREH of pitting potential difference before and after intermediate heat treatment.

FIG. 5 is a graph showing a relation between predicted value PREH of pitting potential difference before and after intermediate heat treatment and RN after salt spray test.

FIG. 6 is a graph showing an influence of Cr content upon corrosion resistance under high-temperature air.

FIG. 7 is a graph showing an influence of Mo content upon corrosion resistance under high-temperature air.

FIG. 8 is a graph showing an influence of Cu content upon corrosion resistance under high-temperature air.

EMBODIMENTS FOR CARRYING OUT THE INVENTION

As previously mentioned, it has been revealed from the inventors' inspections that two types of defects not too recognized up to the present are frequently caused in addition to poor welding and cracking resulted from simple work as a result of classification on the defects relating to the sheathing tube of the sheath heater. As a prevention against these defects will be described results examined on a typical defect as an example.

<Defect of Type I: Corrosion of Electric Water Heater>

Pitting corrosion is caused in a gap between a sheathing tube and a heater support portion of a sheath heater for an industrial water heater having a capacity of 150 liters. In this case, $Cl^-$ concentration of tap water to be heated is about 10 mass ppm, and the heating temperature is about 70° C., and a transitional time up to the occurrence of corrosion is about 8 months. Moreover, the sheathing tube is made of SUS 316 and a thin oxide film is formed over a full surface thereof.

The inventors have made examinations on the cause of the above defect including a portion not causing corrosion, and found out that the thin oxide film existing on the surface of the sheathing tube with the generated defect is formed by an intermediate heat treatment conducted for removing work strain on the way of the production process and subsequently remains without removal. They also found out that the intermediate heat treatment is generally conducted in the sheath heater subjected to severer deformation.

Then, an influence of the oxide film formed on the surface of the sheathing tube upon the corrosion resistance is investigated.

The corrosion resistance of stainless materials used under wetting environment as in the electric water heater is commonly evaluated at a state having no oxide film. The corrosion resistance under such a condition is largely affected by a chemical composition, and has a good interrelation to a pitting resistance equivalent (PRE) represented by the following equation (1):

$$PRE=Cr+3.3\times Mo+16\times N \quad (1)$$

(wherein each element symbol in the above equations represents a content (mass %) of each element), which is known that the larger the PRE value, the better the corrosion resistance.

Now, test pieces having no oxide film on their surfaces are prepared from various materials having different PRE values of the equation (1) and subjected to a salt spray test wherein an aqueous solution of 3.5 mass % NaCl is sprayed at 60° C. for 168 hours. The corrosion resistance is evaluated by an index of corroded area ratio RN (rating number) defined in JIS G0595. Moreover, the smaller the value of RN, the larger the area ratio of generating rusts (the poorer the corrosion resistance).

In FIG. 1 are shown the results of the above test as a relation between PRE and RN. From this figure, it is understood that when the oxide film is not present, if PRE is not less than 20.0, RN value of 9 (area ratio of generating rusts is 0.0093%) is obtained and the corrosion resistance becomes good.

In SUS 316 generating the above defect, PRE is 24.5 and the generation of rusts is not observed. However, when the same test as mentioned above is subjected to a test piece obtained by subjecting SUS 316 to a heat treatment of 950° C.×1 minute in air as a simulation of an intermediate heat treatment to form an oxide film on the surface thereof, the generation of rusts is observed at RN value of 7 even in PRE≥20.0. This result suggests that the oxide film formed by the intermediate heat treatment deteriorates the corrosion resistance and hence the sheath heater subjected to the intermediate heat treatment in the production process of the sheathing tube has not sufficient corrosion resistance.

In order to investigate the influence of the oxide film upon the corrosion resistance of the material for the sheathing tube, the inventors have conducted an experiment wherein test pieces prepared from 34 mass % Ni–2.2 mass % Mo steels having a varied Cr content and 20.5 mass % Ni–20 mass % Cr steels having a varied Mo content are subjected to the aforementioned heat treatment as a simulation of an intermediate heat treatment to form an oxide film on their surfaces and then a pitting potential $VC'_{100}$ ($V_{SCE}$) is measured in a solution of 3.5 mass % NaCl at 70° C. to determine a difference to a pitting potential $VC'_{100}$ ($V_{SCE}$) measured at a state having no oxide film.

The results of the above experiment are shown in FIG. 2 for 34 mass % Ni–2.2 mass % Mo steels and in FIG. 3 for 20.5 mass % Ni–20 mass % Cr steels, respectively. As seen from these figures, the pitting potential at a state having the oxide film formed on the surface is different from the pitting potential at a surface state having no oxide film in points that the pitting potential lowers due to the formation of the oxide film and the difference of the pitting potential before and after the heat treatment tends to become small with the increase of the Cr content added, while the difference is not varied even by increasing the Mo content added and rather the difference tends to become large when the greater amount is added. That is, it is clear that the corrosion resistance lowers at the surface state having the oxide film, but the addition of Cr is effective to suppress the lowering of the corrosion resistance, while the addition of Mo is small in the effect of suppressing the lowering of the corrosion resistance. The effect of Mo at the surface state having the oxide film as mentioned above is a novel knowledge which cannot be predicted from the conventional corrosion test at the surface state having no oxide film.

Next, the inventors have made an experiment wherein materials for the sheathing tube are provided by variously changing Cr, Mo and Cu contents to investigate an influence of an ingredient upon the lowering of the corrosion resistance through the intermediate heat treatment or the difference of pitting potential before and after the heat treatment. The reason why Cu is added to the above material is based on the fact that although Cu is known as an element suppressing the corrosion, there is an example of observing a reddish brown Cu adhered to the surface of the test piece after the corrosion test and the influence of Cu is examined. The heat treating conditions are same as in the aforementioned conditions.

Then, an influence coefficient of each ingredient on the difference of pitting potential before and after the heat treatment of each of the materials obtained in the above experiment is determined by multiple linear regression analysis and an equation predicting the difference of pitting potential before and after the heat treatment of the material is derived from the chemical composition of the material to provide results shown in the following equation (2). In the invention, the predicted value of the difference of pitting potential before and after the heat treatment is also represented as PREH (PRE changing between before and after heat treatment) hereinafter.

$$PREH=411-13.2\times Cr-5.8\times Mo+0.1\times Mo^2+1.2\times Cu \quad (2)$$

wherein each element symbol in the above equations represents a content (mass %) of each element.

As seen from the equation (2), the addition of Cr is effective but the addition of Mo is not effective for suppressing the lowering of the corrosion resistance after the intermediate heat treatment, and also the addition of Cu badly affects the corrosion resistance after the intermediate heat treatment. Further, FIG. 4 shows a PREH predicted from the equation (2) in contrast with the difference of pitting potential actually measured before and after the heat treatment, from which it is understood that both are a very good interrelation and the lowering of the corrosion resistance after the heat treatment can be precisely predicted from the equation (2).

The inventors evaluate the corrosion resistance by RN defined in JIS G0595 when test pieces are taken out from various materials having different PREH values and subjected to a heat treatment simulating the aforementioned intermediate heat treatment to form an oxide film and further to a salt spray test of spraying an aqueous solution of 3.5 mass % NaCl at 60° C. for 168 hours. In FIG. 5 are shown the results of this test. As seen from this figure, the materials satisfying Cr, Mo and Cu contents of PREH≤145.0 indicate the good corrosion resistance even at a surface state after the formation of the oxide film. Incidentally, the aforementioned SUS 316 satisfies PRE≥20.0 but does not satisfy PREH≤145.0 because PREH is 170.9.

As seen from the above experimental results, when it is considered that the intermediate heat treatment becomes essential on the way of the production process at an actual state that deformation conditions subjected to the sheathing tube of the sheath heater become severer, not only the corrosion resistance at a surface state having no oxide film but also the corrosion resistance at a surface state having the oxide film formed are very important, and it is necessary that both conditions of PRE≥20.0 and PREH≤145.0 are satisfied for satisfying such a requirement.

<Defect of Type II: Corrosion of Electrical Water Heater>

In an industrial 4000 watt-electric grill heater for barbecued chicken, high-temperature corrosion is generated just beneath foreign matter adhered to a bending portion of a sheathing tube of a sheath heater. Moreover, the sheathing tube is made of Incoloy 800 and the heating temperature of the sheath heater is about 800° C. and the time taken up to the generation of corrosion is about 4 months.

As a result of the inventors' confirmation on the state of generating the above defect in detail, a local corrosion is observed in most of the cases and a site thereof is a place of observing the adhesion of the foreign matter in the sheath heater arranged at a tight state of contacting the sheathing tubes to each other in use. From this fact, it is suggested that the oxidation corrosion at a state of contacting the materials to each other or adhering the foreign matter becomes severer conditions rather than the corrosion through simple oxidation in high-temperature air.

There is made an experiment of investigating corrosion behavior under a high-temperature air at a state of contacting the sheathing tubes to each other. In this experiment, two sets of two test pieces are sampled from the same material, and the first set is subjected to a heat treatment of 950° C.×1 minute in air to form an oxide film on the surface thereof and then placed in a state of piling the two test pieces one upon the other, while the other set is placed at a state of piling the two test pieces one upon the other without forming the oxide film. These sets are continuously heated at a temperature of 900° C. for 100 hours and then exfoliative scale formed on the surface of the test piece is removed after the completion of the heating. Then, the mass of the two test pieces is measured and a difference to the mass before the experiment is determined as a corrosion quantity through high-temperature oxidation (corrosion weight loss).

In FIGS. 6~8 are shown a relation of Cr, Mo and Cu contents to the above corrosion weight loss, respectively. As seen from FIG. 6, the corrosion weight loss decreases with the increase of Cr content, while the difference of corrosion weight loss before and after the intermediate heat treatment, i.e. between presence and absence of the oxide film also tends to be decreased. From this fact, it is understood that Cr has an effect of suppressing the lowering of the corrosion resistance under a high-temperature air even when the oxide film is existent.

As seen from FIG. 7, Mo has an effect of decreasing the corrosion weight loss in the addition of slight amount, but the addition of the greater amount, particularly the addition exceeding 3 mass % rather increases the corrosion weight loss. As a result of the investigation on this cause, oxygen is consumed at a site of contacting the materials to each other through surface oxidation at the high temperature to provide a low oxygen potential state, so that Mo is preferentially oxidized into a porous state, and hence exfoliative oxide film is formed to increase the corrosion weight loss. If foreign matter or the like is further adhered at this state, the supply of oxygen is more lacking and corrosion is further promoted. Therefore, the addition of an excessive amount of Mo is not preferable.

As seen from FIG. 8, the corrosion amount is largely increased when the Cu content is not less than 0.25 mass %. This is supposed that since reddish brown patchy films are formed non-uniformly on the surface of the test piece as observed after the test, Cu obstructs the formation of uniform oxide film under a high-temperature air. Therefore, the content of Cu badly affecting the corrosion resistance is necessary to be limited.

Next, the inventors have made investigations on the blackening treatability of the sheathing tube. In the sheath heater, particularly sheath heater used under a high-temperature air, the surface of the sheathing tube made from a material added with a given amount of Al or Ti is generally subjected to a heat treatment called as a blackening treatment for efficiently heating an objective to be heated. Since this heat treatment forms a dense black oxide film having a high emissivity on the surface of the sheathing tube, it is different from the intermediate heat treatment conducted on the way of the production process and is conducted under a condition of strictly controlling dew point or ingredient of atmosphere gas.

The inventors have examined elements other than Al, Ti in the sheathing tube having a chemical composition adapted in the invention as mentioned later for improving a blackening treatability, and found that Zr indicates an equal or more blackening treatability in the addition of smaller amount than that of Al or Ti. However, an excessive addition of Al or Ti and Zr is not preferable because a greater amount of carbonitride is formed to generate surface defect. Now, the range capable of simultaneously establishing the blackening treatability and the surface quality is investigated by variously changing the amounts of Al, Ti and Zr added. As a result, it has been found out that when the range satisfies the following equation (3), a dense black oxide film having a high emissivity can be formed without damaging the surface quality after the blackening treatment and also this film does not bring about the lowering of the corrosion resistance as in the oxide film formed on the way of the production process:

$$Al+Ti+1.5\times Zr:0.5\sim1.5 \quad (3)$$

wherein each element symbol in the above equations represents a content (mass %) of each element.

The invention is accomplished by adding further examinations to the aforementioned novel knowledge.

Then, the chemical composition included in the austenitic Fe—Ni—Cr alloy of the invention will be described concretely.

C: 0.005~0.03 mass %

C is an element stabilizing an austenite phase. Also, it has an effect of enhancing an alloy strength through solid-solution strengthening, so that it is necessary to be added in an amount of not less than 0.005 mass % for ensuring the strength at room temperature and higher temperatures. On the other hand, C is an element of causing the lowering of corrosion resistance or the like by forming a carbide together with Cr having a large effect of improving the corrosion resistance to produce Cr-depleted surface layer in the vicinity thereof, so that the upper limit of the addition amount is necessary to be 0.03 mass %. Moreover, the C content is preferably 0.008~0.025 mass %, more preferably 0.010~0.023 mass %.

Si: 0.15~1.0 mass %

Si is an element effective for the improvement of oxidation resistance and the peeling prevention of oxide film, and such effects are obtained by adding in an amount of not less than 0.15 mass %. However, the excessive addition causes the generation of surface defect resulted from the inclusion, so that the upper limit is 1.0 mass %. Moreover, the Si content is preferably 0.17~0.75 mass %, more preferably 0.20~0.70 mass %.

Mn: not more than 2.0 mass %

Mn is an element stabilizing an austenite phase and is also an element required for deoxidation, so that it is preferable to be added in an amount of not less than 0.1 mass %. However, the excessive addition brings about the lowering of the oxidation resistance, so that the upper limit is 2.0 mass %. Moreover, the Mn content is preferably 0.10~1.5 mass %, more preferably 0.15~1.0 mass %.

P: not more than 0.030 mass %

P is a harmful element segregating in a grain boundary to cause cracking in the hot working, so that it is preferable to be decreased as far as possible and hence it is limited to not more than 0.030 mass %. It is preferably not more than 0.028 mass %, more preferably not more than 0.025 mass %.

S: not more than 0.002 mass %

S is an element segregating in a grain boundary to form a low-melting point compound to thereby cause hot cracking or the like in the production, so that it is preferable to be decreased as far as possible and hence it is limited to not more than 0.002 mass %. It is preferably not more than 0.0015 mass %, more preferably not more than 0.0012 mass %.

Cr: 18~28 mass %

Cr is an element effective for improving the corrosion resistance under a wet environment. Also, it has effect of suppressing the lowering of the corrosion resistance due to the oxide film formed by the heat treatment not controlling the atmosphere or dew point as in the intermediate heat treatment. Further, there is an effect of suppressing the corrosion under a high-temperature air. In order to stably ensure the effect of improving the corrosion resistance under the wet environment and under the high-temperature air as mentioned above, it is necessary to be added in an amount of not less than 18 mass %. However, the excessive addition of Cr rather deteriorates the stability of austenite phase and requires the addition of a greater amount of Ni, so that the upper limit is 28 mass %. Moreover, the Cr content is preferably 20~26 mass %, more preferably 20.5~25 mass %.

Ni: 20~38 mass %

Ni is an element stabilizing an austenite phase and is included in an amount of not less than 20 mass % in view of the phase stability. However, the excessive addition leads to the rise of raw material cost, so that the upper limit is 38 mass %. Moreover, the Ni content is preferably 21.5~32 mass %, more preferably 22.5~31.5 mass %.

Mo: 0.10~3 mass %

Mo remarkably improves the corrosion resistance under a chloride existing wet environment and under a high-temperature air even in the addition of a smaller amount, and has an effect of improving the corrosion resistance in proportion to the addition amount. However, it has an improving effect to a certain extent to the corrosion resistance after the oxide film is formed by the intermediate heat treatment, but it is not effective in the addition of the greater amount. Furthermore, when oxygen potential is less on the surface of the material added with the greater amount of Mo under a high-temperature air, Mo is preferentially oxidized to cause peeling of the oxide film, which has rather a bad influence. Therefore, the amount of Mo added is a range of 0.10~3 mass %. Moreover, the Mo content is preferably 0.2~2.8 mass %, more preferably 0.5~2.6 mass %.

Co: 0.05~2.0 mass %

Co is an element effective for stabilizing an austenite phase likewise C, N and Ni. However, C and N form a carbonitride with Al or Ti, Zr and the like to cause the generation of surface defect, so that they cannot be added in a greater amount. In this point, Co does not form the carbonitride, and is advantageous. Such an effect of Co is obtained in the addition of not less than 0.05 mass %. However, the excessive addition brings about the rise of raw material cost, so that it is limited to not more than 2.0 mass %. Moreover, the Co content is preferably 0.05~1.5 mass %, more preferably 0.08~4.3 mass %.

Cu: less than 0.25 mass %

Cu may be added as an element for improving the corrosion resistance under a wet condition, but the effect thereof is hardly observed under a corrosion environment intended in the invention. Rather, a non-uniform film is formed on the surface of the material in a patchy pattern to deteriorate the corrosion resistance remarkably. In the invention, therefore, it is limited to less than 0.25 mass %. It is preferably not more than 0.20 mass %, more preferably not more than 0.16 mass %.

N: not more than 0.02 mass %

N contributes to the texture stabilization because it is an element improving the corrosion resistance of steel and is also an element stabilized austenitic phase. However, N enhances the hardness of the alloy to lower the workability. Also, when Al or Ti, Zr and the like are added, a nitride is formed with these elements to reduce the addition effect of these elements, so that the upper limit is 0.02 mass %. It is preferably not more than 0.018 mass %, more preferably not more than 0.015 mass %.

The austenitic Fe—Ni—Cr alloy of the invention not only satisfies the above chemical composition, but also is necessary to satisfy the following equations (1) and (2).

$$PRE=Cr+3.3\times Mo+16\times N\geq 20.0 \quad \text{Equation (1);}$$

The addition of Cr, Mo and N is effective for improving the corrosion resistance at a surface state having no oxide film. When PRE defined by the equation (1) is not less than 20.0 as a content of these elements (mass %), the corrosion resistance of steel under the wet condition is good. It is preferably PRE≥21.0, more preferably PRE≥21.5.

$$PREH=411-13.2\times Cr-5.8\times Mo+0.1\times Mo^2+1.2\times Cu\geq 145.0 \quad \text{Equation (2);}$$

The corrosion resistance at such a surface state that the oxide film is formed by the intermediate heat treatment or the like on the way of the production process is different from that having no oxide film. That is, Cr effectively act to the corrosion resistance likewise the case having no oxide film, while Mo is not effective and rather creates an adverse result in the addition of the greater amount. As to Cu, the patchy film is non-uniformly formed by the intermediate heat treatment to deteriorate the corrosion resistance. In the invention, therefore, the contents of Cr, Mo and Cu (mass %) are necessary to be added so that PREH defined by the equation (2) is not more than 145.0 for improving the corrosion resistance after the formation of the oxide film. It is preferably PREH≤143, more preferably PREH≤140.

Also, the austenitic Fe—Ni—Cr alloy of the invention may be subjected to a blackening treatment for forming a dense oxide film having a high emissivity on the surface of the sheathing tube. In this case, Al, Ti and Zr are preferable to be added within the following ranges.

Al: 0.10~1.0 mass %, Ti: 0.1~1.0 mass %

Al and Ti are elements effective for the formation of the dense black oxide film having a high emissivity, so that such an effect can be obtained by adding them in an amount of not less than 0.10 mass %, respectively. However, the excessive addition forms a greater amount of a carbonitride to cause the generation of surface defect, so that each upper limit is preferable to be 1.0 mass %. Moreover, each of Al and Ti contents is preferably 0.1~0.6 mass %, more preferably 0.13~0.55 mass %.

Zr: 0.01~0.5 mass %

Zr is a homologous element of Ti and effectively acts to the formation of the dense black oxide film likewise Ti, so that it can be also used as an alternate element of Ti. Since the effect is excellent as compared with that of Ti, there is an effect even in the addition of a small amount such as 0.01 mass %. However, the excessive addition brings about the generation of surface defect due to the formation of much carbonitride, so that the upper limit is preferable to be about 0.5 mass %. Moreover, the Zr content is preferably 0.01~0.35 mass %, more preferably 0.10~0.30 mass %.

$$Al+Ti+1.5\times Zr:0.5\sim 1.5 \text{ mass \%} \qquad \text{Equation (3);}$$

Since Al, Ti and Zr have synergistic effect in the formation of the black oxide film, it is desirable to control the addition amounts by the equation (3) considering the influence degree of the individual element as a unit. In order to stably form the dense black oxide film having a high emissivity, the value obtained by the left side of the equation (3) as Al, Ti and Zr contents (mass %) is preferable to be a range of 0.5~1.5 mass %. When the value is less than 0.5 mass %, the good black oxide film is not obtained, while the excessive addition of more than 1.5 mass % brings about the lowering of surface quality due to the formation of much inclusion. Moreover, the value of the left side in the equation (3) is preferably 0.55~1.35 mass %, more preferably 0.60~1.30 mass %.

O: not more than 0.007 mass %

O forms an oxide to cause the generation of surface defect. Also, if it is bonded to Al, Ti, Zr and the like, the addition effect of these elements is reduced, so that the upper limit is preferable to be 0.007 mass %. It is more preferably not more than 0.005 mass %.

H: not more than 0.010 mass %

When a greater amount of H is incorporated in the melting, porosities are formed in the slab during the solidification to cause the generation of surface defect, so that the upper limit is preferable to be limited to 0.010 mass %. It is more preferably not more than 0.005 mass %.

In the austenitic Fe—Ni—Cr alloy of the invention, the balance other than the above ingredients is Fe and inevitable impurities. However, the other ingredient may be included within a range not obstructing the action and effects of the invention.

EXAMPLES

Each of Fe—Ni—Cr alloy Nos. 1~40 having various chemical compositions shown in Tables 1-1 and 1-2 is melted by a common production process and continuously cast into a slab of 150 mm thickness×1000 mm width. Similarly, there are produced slabs as to SUS 316 (No. 41), Incoloy 800 (No. 42) and SUS 304 (No. 43) as a Reference Example. Then, each of these slabs is heated to 1000~1300° C., hot rolled to form a hot rolled sheet of 3 mm in thickness, annealed, pickled, cold rolled to form a cold rolled sheet of 0.6 mm in thickness, and further annealed and pickled to obtain a cold rolled, annealed sheet.

TABLE 1-1

| | Chemical Composition (mass %) | | | | | | | | | | |
|---|---|---|---|---|---|---|---|---|---|---|---|
| No. | C | Si | Mn | P | S | Cr | Ni | Mo | Co | Cu | N |
| 1 | 0.019 | 0.28 | 0.69 | 0.023 | 0.0005 | 26.77 | 34.19 | 2.15 | 0.13 | 0.09 | 0.016 |
| 2 | 0.022 | 0.33 | 0.71 | 0.024 | 0.0013 | 20.41 | 33.97 | 2.23 | 0.14 | 0.10 | 0.012 |
| 3 | 0.027 | 0.23 | 0.73 | 0.026 | 0.0010 | 20.23 | 20.53 | 2.88 | 0.07 | 0.11 | 0.005 |
| 4 | 0.029 | 0.22 | 0.72 | 0.022 | 0.0009 | 20.05 | 20.48 | 0.67 | 0.09 | 0.09 | 0.010 |
| 5 | 0.023 | 0.31 | 0.38 | 0.004 | 0.0011 | 24.60 | 37.60 | 2.51 | 0.21 | 0.17 | 0.017 |
| 6 | 0.021 | 0.49 | 0.34 | 0.019 | 0.0010 | 22.01 | 20.21 | 2.92 | 0.33 | 0.20 | 0.013 |
| 7 | 0.016 | 0.22 | 0.29 | 0.009 | 0.0014 | 23.01 | 25.46 | 0.60 | 1.92 | 0.19 | 0.017 |
| 8 | 0.006 | 0.34 | 0.41 | 0.026 | 0.0018 | 25.89 | 34.70 | 2.26 | 0.06 | 0.22 | 0.014 |
| 9 | 0.021 | 0.47 | 1.05 | 0.009 | 0.0005 | 20.55 | 30.11 | 0.69 | 0.84 | 0.24 | 0.005 |
| 10 | 0.019 | 0.43 | 0.96 | 0.007 | 0.0016 | 20.56 | 30.05 | 0.68 | 0.90 | 0.16 | 0.013 |
| 11 | 0.023 | 0.31 | 0.73 | 0.027 | 0.0008 | 24.59 | 33.75 | 2.21 | 0.09 | 0.08 | 0.014 |
| 12 | 0.026 | 0.25 | 0.71 | 0.022 | 0.0012 | 20.19 | 20.49 | 1.50 | 0.08 | 0.10 | 0.009 |
| 13 | 0.012 | 0.73 | 0.69 | 0.024 | 0.0008 | 22.38 | 29.56 | 1.79 | 0.12 | 0.08 | 0.015 |
| 14 | 0.011 | 0.62 | 0.67 | 0.022 | 0.0006 | 24.98 | 22.60 | 1.45 | 1.70 | 0.07 | 0.007 |
| 15 | 0.022 | 0.55 | 0.80 | 0.018 | 0.0013 | 21.50 | 29.92 | 0.88 | 0.88 | 0.05 | 0.012 |
| 16 | 0.018 | 0.44 | 1.02 | 0.023 | 0.0009 | 20.65 | 30.10 | 0.73 | 0.85 | 0.04 | 0.009 |
| 17 | 0.018 | 0.48 | 0.65 | 0.022 | 0.0008 | 25.60 | 34.09 | 2.09 | 0.16 | 0.08 | 0.018 |
| 18 | 0.019 | 0.18 | 0.33 | 0.023 | 0.0016 | 20.51 | 34.02 | 2.19 | 0.12 | 0.09 | 0.004 |
| 19 | 0.008 | 0.51 | 1.12 | 0.026 | 0.0004 | 20.58 | 20.28 | 0.13 | 1.41 | 0.17 | 0.019 |
| 20 | 0.019 | 0.79 | 1.38 | 0.011 | 0.0009 | 18.95 | 34.80 | 2.95 | 0.34 | 0.05 | 0.010 |
| 21 | 0.021 | 0.22 | 0.33 | 0.019 | 0.0010 | 24.48 | 37.51 | 2.58 | 0.29 | 0.13 | 0.018 |

| | Chemical Composition (mass %) | | | | | PRE of Equation | PREH of Equation | Ti + Al + 1.5 Zr of Equation | |
|---|---|---|---|---|---|---|---|---|---|
| No. | O | H | Al | Ti | Zr | (1) | (2) | (3) | Remarks |
| 1 | 0.0040 | 0.0007 | — | — | — | 34.1 | 45.7 | — | Invention Example |
| 2 | 0.0033 | 0.0010 | — | — | — | 28.0 | 129.3 | — | Invention Example |
| 3 | 0.0036 | 0.0020 | — | — | — | 29.8 | 128.2 | — | Invention Example |
| 4 | 0.0034 | 0.0020 | — | — | — | 22.4 | 142.6 | — | Invention Example |
| 5 | 0.0051 | 0.0080 | — | — | — | 33.2 | 72.6 | — | Invention Example |
| 6 | 0.0034 | 0.0050 | — | — | — | 31.9 | 104.6 | — | Invention Example |
| 7 | 0.0027 | 0.0040 | — | — | — | 25.3 | 104.1 | — | Invention Example |
| 8 | 0.0019 | 0.0070 | | | | 33.6 | 56.9 | — | Invention Example |
| 9 | 0.0013 | 0.0020 | — | — | — | 22.9 | 136.1 | — | Invention Example |

TABLE 1-1-continued

| | | | | | | | | | |
|---|---|---|---|---|---|---|---|---|---|
| 10 | 0.0009 | 0.0060 | | | | 23.0 | 135.9 | | Invention Example |
| 11 | 0.0023 | 0.0050 | — | — | — | 32.1 | 74.2 | — | Invention Example |
| 12 | 0.0039 | 0.0030 | — | — | — | 25.3 | 136.1 | — | Invention Example |
| 13 | 0.0020 | 0.0020 | — | — | — | 28.5 | 105.6 | — | Invention Example |
| 14 | 0.0018 | 0.0030 | — | — | — | 29.9 | 73.1 | — | Invention Example |
| 15 | 0.0028 | 0.0060 | — | — | — | 24.6 | 122.2 | — | Invention Example |
| 16 | 0.0037 | 0.0040 | — | — | — | 23.2 | 134.3 | — | Invention Example |
| 17 | 0.0058 | 0.0030 | 0.78 | 0.35 | 0.22 | 32.8 | 61.5 | 1.46 | Invention Example |
| 18 | 0.0032 | 0.0020 | 0.12 | 0.22 | 0.17 | 27.8 | 128.2 | 0.60 | Invention Example |
| 19 | 0.0041 | 0.0010 | 0.61 | 0.64 | 0.06 | 21.3 | 138.8 | 1.34 | Invention Example |
| 20 | 0.0064 | 0.0040 | 0.41 | 0A4 | 0.37 | 28.8 | 144.7 | 1.41 | Invention Example |
| 21 | 0.0022 | 0.0030 | 0.44 | 0.14 | 0.48 | 33.3 | 73.7 | 1.30 | Invention Example |

TABLE 1-2

| | Chemical Composition (mass %) | | | | | | | | | | |
|---|---|---|---|---|---|---|---|---|---|---|---|
| No. | C | Si | Mn | P | S | Cr | Ni | Mo | Co | Cu | N |
| 22 | 0.009 | 0.34 | 0.85 | 0.006 | 0.0003 | 26.43 | 26.28 | 0.55 | 0.20 | 0.03 | 0.015 |
| 23 | 0.022 | 0.25 | 1.23 | 0.024 | 0.0018 | 20.11 | 22.82 | 0.20 | 0.99 | 0.09 | 0.003 |
| 24 | 0.014 | 0.97 | 0.98 | 0.010 | 0.0008 | 22.03 | 28.77 | 0.56 | 0.32 | 0.02 | 0.012 |
| 25 | 0.025 | 0.59 | 0.76 | 0.021 | 0.0012 | 21.67 | 20.19 | 1.99 | 0.45 | 0.11 | 0.006 |
| 26 | 0.006 | 0.88 | 0.56 | 0.009 | 0.0015 | 23.44 | 29.74 | 0.18 | 1.25 | 0.20 | 0.007 |
| 27 | 0.010 | 0.18 | 0.94 | 0.003 | 0.0011 | 24.09 | 33.66 | 0.13 | 0.66 | 0.14 | 0.019 |
| 28 | 0.018 | 0.64 | 0.77 | 0.018 | 0.0013 | 22.95 | 25.50 | 1.02 | 0.37 | 0.05 | 0.013 |
| 29 | 0.017 | 0.34 | 0.45 | 0.020 | 0.0011 | 20.00 | 20.65 | 2.98 | 0.31 | 0.04 | 0.012 |
| 30 | 0.022 | 0.22 | 0.41 | 0.011 | 0.0018 | 25.00 | 22.23 | 1.92 | 0.50 | 0.06 | 0.015 |
| 31 | 0.0012 | 0.32 | 0.45 | 0.025 | 0.0014 | 18.30 | 30.06 | 0.15 | 0.29 | 0.24 | 0.021 |
| 32 | 0.017 | 0.39 | 0.77 | 0.027 | 0.0007 | 19.05 | 36.98 | 0.08 | 0.31 | 0.14 | 0.016 |
| 33 | 0.018 | 0.29 | 0.67 | 0.025 | 0.0013 | 15.56 | 34.21 | 2.18 | 0.09 | 0.10 | 0.010 |
| 34 | 0.021 | 0.43 | 0.48 | 0.022 | 0.0011 | 20.01 | 26.70 | 0.19 | 0.21 | 0.14 | 0.013 |
| 35 | 0.022 | 0.45 | 1.01 | 0.014 | 0.0016 | 20.50 | 30.11 | 0.70 | 0.81 | 0.29 | 0.012 |
| 36 | 0.027 | 0.22 | 0.70 | 0.021 | 0.0012 | 20.19 | 20.49 | 4.41 | 0.08 | 0.10 | 0.009 |
| 37 | 0.028 | 0.58 | 0.81 | 0.018 | 0.0011 | 26.51 | 36.11 | 1.22 | 0.48 | 0.21 | 0.016 |
| 38 | 0.016 | 0.30 | 0.68 | 0.021 | 0.0013 | 24.56 | 26.70 | 1.60 | 0.88 | 0.11 | 0.013 |
| 39 | 0.017 | 0.42 | 0.89 | 0.023 | 0.0005 | 21.90 | 24.56 | 2.69 | 1.30 | 0.09 | 0.009 |
| 40 | 0.026 | 0.45 | 1.00 | 0.010 | 0.0019 | 22.30 | 28.11 | 0.89 | 0.22 | 0.04 | 0.010 |
| 41 | 0.011 | 0.69 | 1.21 | 0.034 | 0.0006 | 17.34 | 12.11 | 2.05 | 0.01 | 0.23 | 0.024 |
| 42 | 0.012 | 0.27 | 0.24 | 0.018 | 0.0002 | 20.01 | 30.39 | 0.02 | — | 0.04 | 0.010 |
| 43 | 0.010 | 0.71 | 1.50 | 0.036 | 0.0059 | 18.11 | 8.73 | 0.01 | — | 0.30 | 0.001 |

| | Chemical Composition (mass %) | | | | | PRE of Equation | PREH of Equation | Ti + Al + 1.5 Zr of Equation | |
|---|---|---|---|---|---|---|---|---|---|
| No. | O | H | Al | Ti | Zr | (1) | (2) | (3) | Remarks |
| 22 | 0.0006 | 0.0060 | 0.52 | — | — | 28.5 | 59.0 | 0.52 | Invention Example |
| 23 | 0.0030 | 0.0020 | 0.08 | 0.51 | — | 20.8 | 144.4 | 0.59 | Invention Example |
| 24 | 0.0009 | 0.0030 | 0.01 | 0.01 | 0.56 | 24.1 | 117.0 | 0.86 | Invention Example |
| 25 | 0.0019 | 0.0030 | 0.33 | 0.26 | — | 28.3 | 113.9 | 0.59 | Invention Example |
| 26 | 0.0011 | 0.0010 | 0.01 | 0.22 | 0.29 | 24.1 | 100.8 | 0.67 | Invention Example |
| 27 | 0.0031 | 0.0040 | 0.27 | — | 0.26 | 24.8 | 92.4 | 0.66 | Invention Example |
| 28 | 0.0023 | 0.0060 | 0.37 | 0.45 | 0.09 | 26.5 | 102.3 | 0.96 | Invention Example |
| 29 | 0.0036 | 0.0040 | 0.17 | 0.34 | 0.09 | 30.0 | 130.7 | 0.65 | Invention Example |
| 30 | 0.0038 | 0.0030 | 0.31 | 0.12 | 0.35 | 31.6 | 70.3 | 0.96 | Invention Example |
| 31 | 0.0009 | 0.0010 | — | — | — | 19.1 | 168.9 | — | Comparative Example |
| 32 | 0.0036 | 0.0076 | — | — | — | 19.6 | 159.2 | — | Comparative Example |
| 33 | 0.0050 | 0.0012 | — | — | — | 22.9 | 193.6 | — | Comparative Example |

TABLE 1-2-continued

| | | | | | | | | | |
|---|---|---|---|---|---|---|---|---|---|
| 34 | 0.0039 | 0.0021 | — | — | — | 20.8 | 145.9 | — | Comparative Example |
| 35 | 0.0020 | 0.0032 | — | — | — | 23.0 | 136.7 | — | Comparative Example |
| 36 | 0.0033 | 0.0025 | — | — | — | 34.9 | 121.0 | — | Comparative Example |
| 37 | 0.0019 | 0.0022 | 0.03 | 0.27 | 0.08 | 30.8 | 54.4 | 0.42 | Invention Example |
| 38 | 0.0020 | 0.0011 | 0.41 | 0.02 | — | 30.0 | 77.9 | 0.43 | Invention Example |
| 39 | 0.0023 | 0.0056 | 0.07 | 0.19 | 0.008 | 30.9 | 107.1 | 0.27 | Invention Example |
| 40 | 0.0014 | 0.0020 | 0.21 | 0.13 | 0.05 | 25.4 | 111.6 | 0.42 | Invention Example |
| 41 | 0.0028 | 0.0011 | 0.004 | 0.003 | — | 24.5 | 170.9 | 0.01 | Reference Example |
| 42 | 0.0008 | 0.0012 | 0.358 | 0.415 | — | 20.2 | 146.8 | 0.77 | Reference Example |
| 43 | 0.0040 | 0.0010 | 0.004 | — | — | 18.2 | 172.3 | 0.004 | Reference Example |

A test piece is taken out from each of the thus obtained cold rolled, annealed sheets and then subjected to the following tests.

<Salt Spray Test>

In order to evaluate the corrosion resistance at a surface state before and after the intermediate heat treatment on the way of the production process, a test piece of 60×80 mm is taken out from each of the cold rolled, annealed sheets, and thereafter there are provided two types of test pieces wherein the surface of the above test piece is wet-polished with a #600 emery paper as a first test piece and further the polished test piece is subjected to a heat treatment of 950° C.×1 minute in air to form a thin oxide film on the surface thereof as a second test piece. These test piece are subjected to a salt spray test of continuously spraying an aqueous solution of 3.5 mass % NaCl at 60° C. for 168 hours. Moreover, the corrosion resistance is determined by evaluating an area of rusts generated on the surface of the test piece after the salt spray test through RN defined in JIS G0595 and judged by good corrosion resistance (○) when RN is 9 and bad corrosion resistance (X) when RN is not more than 8.

<Corrosion Resistance Under High-Temperature Air>

In order to evaluate the corrosion resistance under a high-temperature air when the materials are contacted with each other, there are provided the same two types of test pieces as in the above slat spray test, and then these test pieces are superposed one upon the other and subjected to a continuous oxidation test of 900° C.×100 hours in the atmosphere. The corrosion resistance is determined by removing exfoliative scale adhered to the surface of the two test pieces after the test and measuring the mass of the test piece to determine a difference to the mass before the test (corrosion weight loss) and judged by good corrosion resistance (○) when the corrosion weight loss is less than 10 mg/cm$^2$ and bad corrosion resistance (X) when it is not less than 10 mg/cm$^2$.

<Blackening Treatability>

A test piece of 25×50 mm is taken out from steel sheets Nos. 17~30 and Nos. 37~40 containing one or more of Ti, Al and Zr and Reference Examples (Nos. 41~43) among the cold rolled, annealed sheets, wet-polished on the surface thereof with a #600 emery paper and then subjected to a heat treatment of 1010° C.×10 minutes in a nitrogen gas atmosphere having a dew point adjusted to −20° C. to form a black oxide film on the surface of the test piece. Thereafter, the emissivity of the black oxide film is measured with am emissivity measuring device (TSS-5X, made by Japan Sensor Co., Ltd.), and the blackening property is judged by good (○) when the emissivity is not less than 0.3 and bad (X) when the emissivity is less than 0.3.

The results of the above tests are shown in Table 2.

As seen from Table 2, all of the alloys Nos. 1~30 adapted to the invention indicate an excellent corrosion resistance even in the salt spray test and the corrosion test under the high-temperature air irrespectively of the conditions before and after the heat treatment, i.e. presence or absence of the formation of oxide film. Among them, the alloys Nos. 17~30 containing one or more of Ti, Al and Zr are also excellent in the blackening treatability.

On the contrary, the alloys (Nos. 31, 32) not satisfying the equation (1) of the invention are judged by bad corrosion resistance in the salt spray test before the heat treatment and the corrosion test under the high-temperature air, and the alloys (Nos. 31~34) not satisfying the equation (2) of the invention are judged by bad corrosion resistance in the salt spray test after the heat treatment and the corrosion test under the high-temperature air.

Furthermore, the alloys Nos. 35, 36 satisfying the equations (1) and (2) of the invention but having Mo or Cu content outside of the invention are good in the corrosion resistance before the heat treatment but are bad in the corrosion resistance after the heat treatment.

Moreover, the alloys Nos. 37~40 satisfying the chemical composition of the invention but having Al, Ti and Zr contents outside the preferable ranges of the invention are excellent in the corrosion resistance, but are judged by bad emissivity because the oxide film after the blackening treatment is green.

In addition, SUS 316 (No. 41) and Incoloy 800 (No. 42) of Reference Examples are good in the corrosion resistance in the salt spray test and the corrosion test under the high-temperature air before the intermediate heat treatment (before the formation of oxide film), but are bad in the corrosion resistance in the salt spray test and the corrosion test under the high-temperature air after the heat treatment (after the formation of oxide film). Also, SUS 304 (No. 43) is judged by bad corrosion resistance in all of the salt spray test and corrosion test under the high-temperature air.

TABLE 2

| No. | PRE of Equation (1) | PREH of Equation (2) | Ti + Al + 1.5 Zr of Equation (3) | Evaluation results of surface properties: Salt water spray test (Before heat treatment) | Salt water spray test (After heat treatment) | Corrosion test under high-temperature air (Before heat treatment) | Corrosion test under high-temperature air (After heat treatment) | Blacking treatability | Remarks |
|---|---|---|---|---|---|---|---|---|---|
| 1 | 34.1 | 45.7 | — | ○ | ○ | ○ | ○ | — | Invention Example |
| 2 | 28.0 | 129.3 | — | ○ | ○ | ○ | ○ | — | Invention Example |
| 3 | 29.8 | 128.2 | — | ○ | ○ | ○ | ○ | — | Invention Example |
| 4 | 22.4 | 142.6 | — | ○ | ○ | ○ | ○ | — | Invention Example |
| 5 | 33.2 | 72.6 | — | ○ | ○ | ○ | ○ | — | Invention Example |
| 6 | 31.9 | 104.6 | — | ○ | ○ | ○ | ○ | — | Invention Example |
| 7 | 25.3 | 104.1 | — | ○ | ○ | ○ | ○ | — | Invention Example |
| 8 | 33.6 | 56.9 | — | ○ | ○ | ○ | ○ | — | Invention Example |
| 9 | 22.9 | 136.1 | — | ○ | ○ | ○ | ○ | — | Invention Example |
| 10 | 23.0 | 135.9 | — | ○ | ○ | ○ | ○ | — | Invention Example |
| 11 | 32.1 | 74.2 | — | ○ | ○ | ○ | ○ | — | Invention Example |
| 12 | 25.3 | 136.1 | — | ○ | ○ | ○ | ○ | — | Invention Example |
| 13 | 28.5 | 105.6 | — | ○ | ○ | ○ | ○ | — | Invention Example |
| 14 | 29.9 | 73.1 | — | ○ | ○ | ○ | ○ | — | Invention Example |
| 15 | 24.6 | 122.2 | — | ○ | ○ | ○ | ○ | — | Invention Example |
| 16 | 23.2 | 134.3 | — | ○ | ○ | ○ | ○ | — | Invention Example |
| 17 | 32.8 | 61.5 | 1.46 | ○ | ○ | ○ | ○ | ○ | Invention Example |
| 18 | 27.8 | 128.2 | 0.60 | ○ | ○ | ○ | ○ | ○ | Invention Example |
| 19 | 21.3 | 138.8 | 1.34 | ○ | ○ | ○ | ○ | ○ | Invention Example |
| 20 | 28.8 | 144.7 | 1.41 | ○ | ○ | ○ | ○ | ○ | Invention Example |
| 21 | 33.3 | 73.7 | 1.30 | ○ | ○ | ○ | ○ | ○ | Invention Example |
| 22 | 28.5 | 59.0 | 0.52 | ○ | ○ | ○ | ○ | ○ | Invention Example |
| 23 | 20.8 | 144.4 | 0.59 | ○ | ○ | ○ | ○ | ○ | Invention Example |
| 24 | 24.1 | 117.0 | 0.86 | ○ | ○ | ○ | ○ | ○ | Invention Example |
| 25 | 28.3 | 113.9 | 0.59 | ○ | ○ | ○ | ○ | ○ | Invention Example |
| 26 | 24.1 | 100.8 | 0.67 | ○ | ○ | ○ | ○ | ○ | Invention Example |
| 27 | 28.8 | 39.6 | 0.66 | ○ | ○ | ○ | ○ | ○ | Invention Example |
| 28 | 26.5 | 102.3 | 0.96 | ○ | ○ | ○ | ○ | ○ | Invention Example |
| 29 | 30.0 | 130.7 | 0.65 | ○ | ○ | ○ | ○ | ○ | Invention Example |
| 30 | 31.6 | 70.3 | 0.96 | ○ | ○ | ○ | ○ | ○ | Invention Example |
| 31 | 19.1 | 168.9 | — | x | x | x | x | — | Comparative Example |
| 32 | 19.6 | 159.2 | — | x | x | x | x | — | Comparative Example |
| 33 | 22.9 | 193.6 | — | ○ | x | ○ | x | — | Comparative Example |
| 34 | 20.8 | 145.9 | — | ○ | x | ○ | x | — | Comparative Example |
| 35 | 23.0 | 136.7 | — | ○ | x | ○ | x | — | Comparative Example |
| 36 | 34.9 | 121.0 | — | ○ | x | ○ | x | — | Comparative Example |
| 37 | 30.8 | 54.4 | 0.42 | ○ | ○ | ○ | ○ | x | Invention Example |
| 38 | 30.0 | 77.9 | 0.43 | ○ | ○ | ○ | ○ | x | Invention Example |
| 39 | 30.9 | 107.1 | 0.27 | ○ | ○ | ○ | ○ | x | Invention Example |
| 40 | 25.4 | 111.6 | 0.42 | ○ | ○ | ○ | ○ | x | Invention Example |
| 41 | 24.5 | 170.9 | 0.01 | ○ | x | ○ | x | x | Reference Example |
| 42 | 20.2 | 146.8 | 0.77 | ○ | x | ○ | x | ○ | Reference Example |
| 43 | 18.2 | 172.3 | 0.004 | x | x | x | x | x | Reference Example |

INDUSTRIAL APPLICABILITY

The Fe—Ni—Cr alloy of the invention is used not only in the sheathing tube of the sheath heater as mentioned above, but also can be preferably used as a material used under a high-temperature environment such as heat exchanger, combustion parts or the like owing to excellent heat resistance and as a material used in chemical industries owing to excellent corrosion resistance.

The invention claimed is:

1. An austenitic Fe—Ni—Cr alloy having a chemical composition comprising

C: 0.005~0.03 mass %,
Si: 0.17~1.0 mass %,
Mn: not more than 2.0 mass %,
P: not more than 0.030 mass %,
S: not more than 0.0015 mass %,
Cr: 18~28 mass %,
Ni: 22.5~31.5 mass %,
Mo: 0.10~2.8 mass %,
Co: 0.05~2.0 mass %,
Cu: 0.04~0.25 mass %,
N: 0.003~0.018 mass %,
Al: 0.13~0.55 mass%,
Ti: 0.13~0.55 mass %,
Zr: 0.01~0.5 mass %, and
O: not more than 0.007 mass%,
H: not more than 0.010 mass%, and
the balance being Fe and inevitable impurities;

wherein Cr, Mo, N and Cu satisfy the following equations (1) and (2):

$$PRE=Cr+3.3\times Mo+16\times N\geq 20.0 \quad (1)$$

$$PREH=411-13.2\times Cr-5.8\times Mo+0.1\times Mo^2+1.2\times Cu\leq 145.0 \quad (2)$$

and wherein Al, Ti, and Zr satisfy the following equation (3):

$$0.5\leq Al+Ti+1.5\times Zr\leq 1.5 \quad (3)$$

wherein each element symbol in the above equations represents a mass % content of each element.

2. A sheath heater comprising a sheathing tube consisting of the austenitic Fe—Ni—Cr alloy of claim 1.

* * * * *